United States Patent [19]

Bordons Elorza

[11] 3,942,450

[45] Mar. 9, 1976

[54] OVERHEAD TRANSPORTATION SYSTEM

[76] Inventor: Carlos Bordons Elorza, Plza. San Juan de la Cruz, 3 Madrid-3, Spain

[22] Filed: Sept. 17, 1974

[21] Appl. No.: 506,776

[30] Foreign Application Priority Data

Apr. 5, 1974 Spain ..... 425042

[52] U.S. Cl. ..... 104/121; 105/147

[51] Int. Cl.[2] ..... B61B 13/04; B61C 13/08

[58] Field of Search ..... 104/89, 91, 93–95, 104/106, 107, 109, 110, 118, 119, 121, 124, 125; 105/141, 142, 144–149, 154, 155

[56] References Cited

UNITED STATES PATENTS

| | | | |
|---|---|---|---|
| 845,459 | 2/1907 | Gilstrap | 104/91 |
| 3,083,649 | 4/1963 | Nelson | 104/121 |
| 3,122,105 | 2/1964 | Scherer | 104/121 X |
| 3,194,179 | 7/1965 | Scherer | 104/121 |
| 3,618,531 | 11/1971 | Eichholz | 104/121 |
| 3,760,737 | 9/1973 | Becker et al. | 104/118 X |

FOREIGN PATENTS OR APPLICATIONS

| | | | |
|---|---|---|---|
| 9,968 | 10/1927 | Australia | 104/91 |
| 1,765 | 7/1865 | United Kingdom | 104/93 |

*Primary Examiner*—Evon C. Blunk
*Assistant Examiner*—Andres Kashnikow
*Attorney, Agent, or Firm*—Wenderoth, Lind & Ponack

[57] ABSTRACT

An overhead transportation system comprises one or more roller tracks joined in a superimposed manner to one or to both sides of a plurality of pillars or columns which form the supporting assembly of the system. Each of the roller tracks is formed of two U-shaped elements arranged parallelly to each other and whose cavities face each other. Each pair of U-shaped elements are connected to the supporting assembly parallel to the vertical axis thereof or slightly inclined thereto. A movable vertebrated or segmented train element includes a series of interconnecting compartments which are pivotally joined to each other in an alternate manner, about vertical axles at the surface thereof nearest to the roller tracks, and about horizontal axles at the base thereof. Tilting, during high speed travel around curves, of the compartments is not allowed, but tilting of the frames of the seats, completely independent of the compartments, is allowed, such tilting being activated hydraulically or mechanically to achieve the required inclination. Damping is effected by the flexible or resilient surface of the roller track and the fastening and guide assemblies, and may be aided by the provision of leaf springs incorporated therein.

5 Claims, 5 Drawing Figures

OVERHEAD TRANSPORTATION SYSTEM

BACKGROUND AND SUMMARY OF THE INVENTION

The present invention relates to an overhead transportation system comprising the following fundamental elements which differ from those presently known:

a. At least one, and preferably a plurality of tracks, formed by two U-shaped elements made of metal or any other suitable material arranged parallelly to each other and the cavities of which face each other. Each pair of these U-shaped elements are connected to a supporting assembly such that an axis of the two U-shaped elements is parallel, or slightly inclined, with respect to the supporting assembly.

b. A supporting assembly is formed by a plurality or pillars or columns which have conventional technical characteristics and which have a necessary size to meet the requirements of a particular installation with regard to stresses and to the number of circulations or tracks.

c. A movable vertebrated or segmented train element is as light as is allowed in technology and includes a series of interconnecting compartments which are pivotally joined to each other in an alternate manner. That is, connection between a first and second compartments is about a vertical axis at the compartment surface nearest the roller track. Connection between the second and a third compartments is about a horizontal axis at the lower plane of the compartments. These two types of pivotal connection are alternated. The train element is mounted in the track by an assembly of wheels connected to each of the axles, such that the train element may slide along the track.

d. Traction or driving movement is imparted to certain of the wheels of the wheel assembly, for example by means of electrical energy supplied thereto in a known manner and controlled from a control cabin.

The overhead transportation system of the invention can have different high speed propelling means, since its directional stability in a straight line, on horizontal curves and on vertical curves is guaranteed, and since there is no possibility of its overturning.

The vertical superimposition of plural tracks, which permits parallel circulation in any direction when connected to both sides of the supporting assembly, is contemplated when required by the density of the traffic, thereby reducing to a minimum the space required, i.e. basically the space required for the supporting pillars or columns.

During displacement of the vertebrated train elements, upward movement of the compartments is not permitted, but may be provided for the frames of the seats as desired due to the inclination and speed of circulation, and may be accomplished, e.g. hydraulically or mechanically.

Damping of the assembly is achieved by the flexible or resilient surface of the driving and fastening assemblies, and may be aided by the provision of leaf springs incorporated therein.

The main traction wheels are located at the end of the axles which extend horizontally between alternate compartment connections, i.e. those axles which allow for vertical curves, and may be provided with electric-generator brakes. The fastening and guide wheels, on the other hand, are located at the ends of the vertical axles, i.e. those axles which allow for horizontal curves, and may be provided with disc brakes.

Emergency exits from a vertebrated train element nearest to the ground may be provided by extensible stairs or steps from the bottom of the compartments. Such exit, in the case of train elements which travel along higher tracks, may be provided through the top or bottom of compartments, even to other train elements.

The advantages which this novel overhead transportation system has over those presently in use are the following:

1. A minimum of space is required, since the number of possible circulations or tracks is multiplied by two, four, six, etc.
2. The supporting assembly is fully taken advantage of, since 2, 4, 6 or more circulations or tracks are provided.
3. Maximum directional stability at high speeds is guaranteed by the fastening system.
4. Changes in direction, similar to that of the traditional track system, are allowed.
5. Emergency exits provide safety since evacuation to other train elements, upper or lower, is possible.
6. Rapid and uniform exits for all the passengers at stations is possible.
7. Simplicity of the track assembly is provided.
8. The assembly is economic with regard to the structure in relation to the number of possible circulations or tracks.
9. The transport elements may be extremely light weight.
10. Transportation of both passengers or merchandise is possible.
11. Very wide ranges of speed are possible, from normal urban to inter-urban speeds. Average speeds of up to 300 km. per hour can be provided.

BRIEF DESCRIPTION OF THE DRAWINGS

Other features of the invention will become apparent from the following detailed description, taken with the accompanying drawings, wherein.

DETAILED DESCRIPTION OF THE INVENTION

Figure 1:
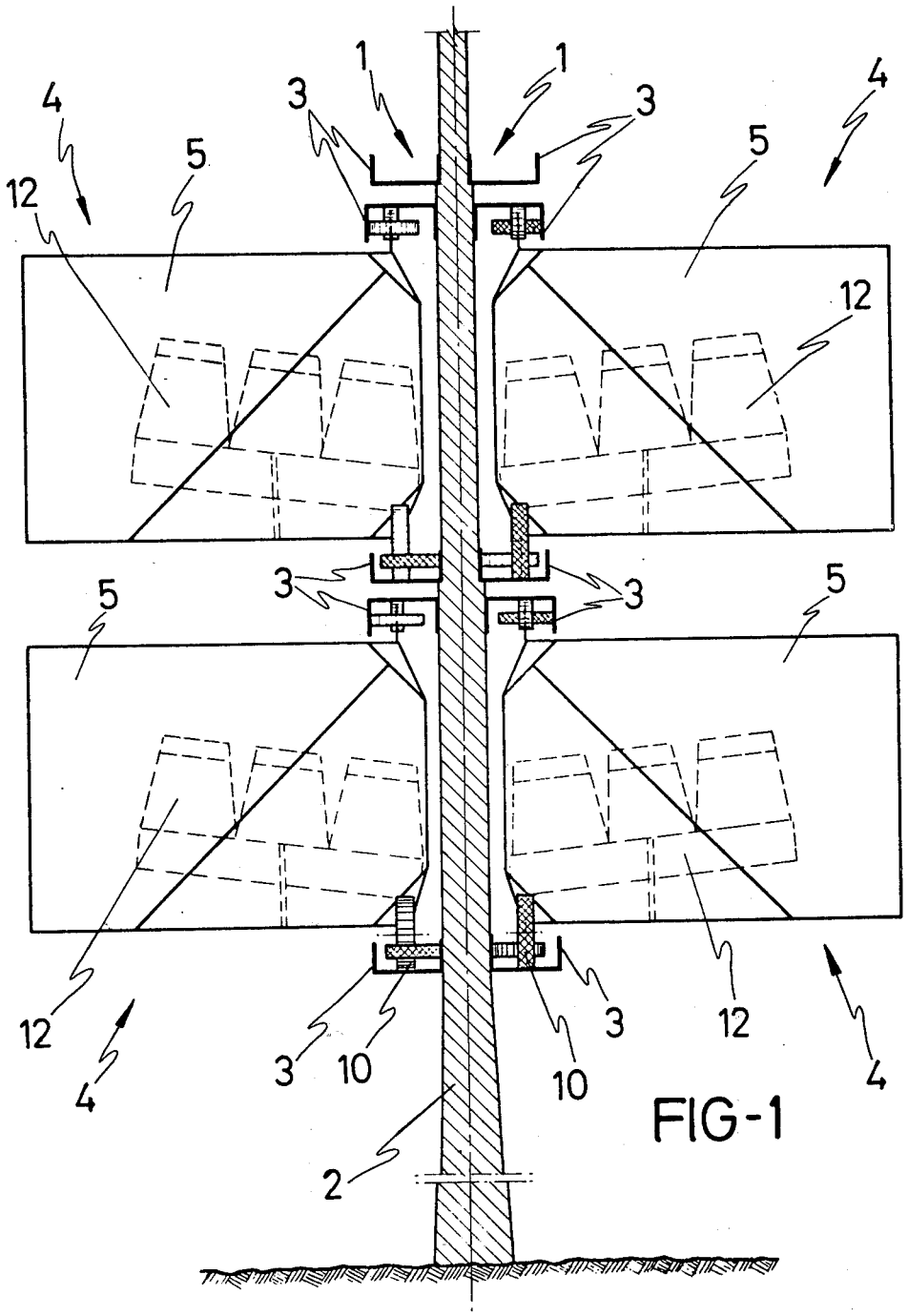
FIG. 1 is a schematic elevational view, partially in cross-section, of an overhead transportation system according to the present invention.

As shown in FIG. 1, the overhead transportation system according to the present invention includes a plurality of pillars or columns 2 which form a supporting assembly. As can be seen, at both sides of columns 2 and in vertical superimposed relationship, there are provided a plurality of fixed roller tracks 1, each composed of a pair of U-shaped elements 3 to which the interconnecting compartments 5 of movable vertebrated or segmented train elements 4 are connected by corresponding wheel assemblies which act as fasteners and guides. The dotted lines represent slightly inclined positions of the frames of seats 12, the arrangement being such that the seats may raise depending on the speed of circulation around curves. Naturally, during straight lineal movement, the mechanical or hydraulic drives which control the raising of the seat frames will remain inoperative, so that the seat frames can adopt a parallel position with respect to a horizontal plane.

Figure 2:
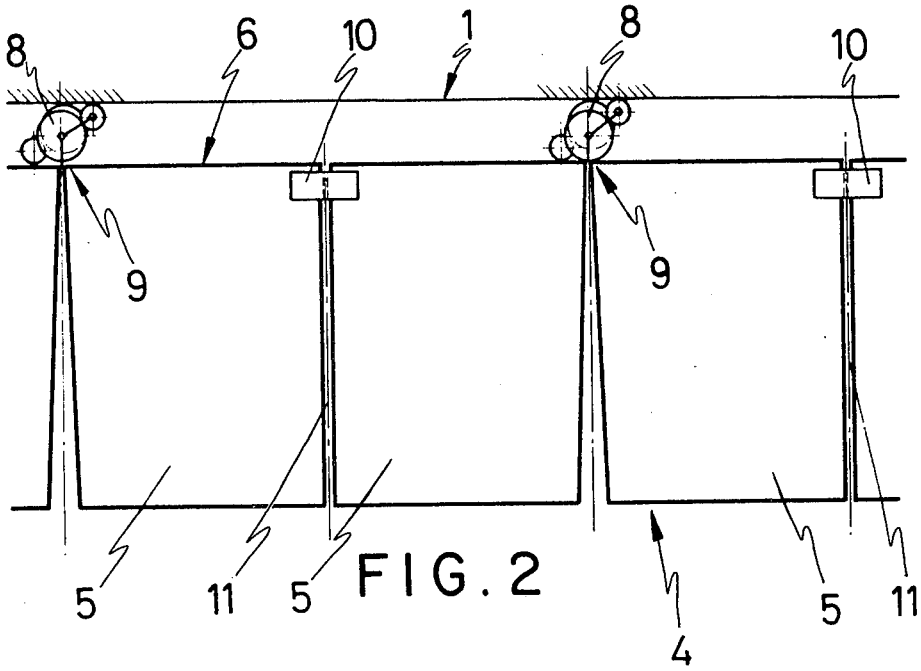
FIG. 2 is a schematic plan view of the system of FIG. 1.
Figure 3:
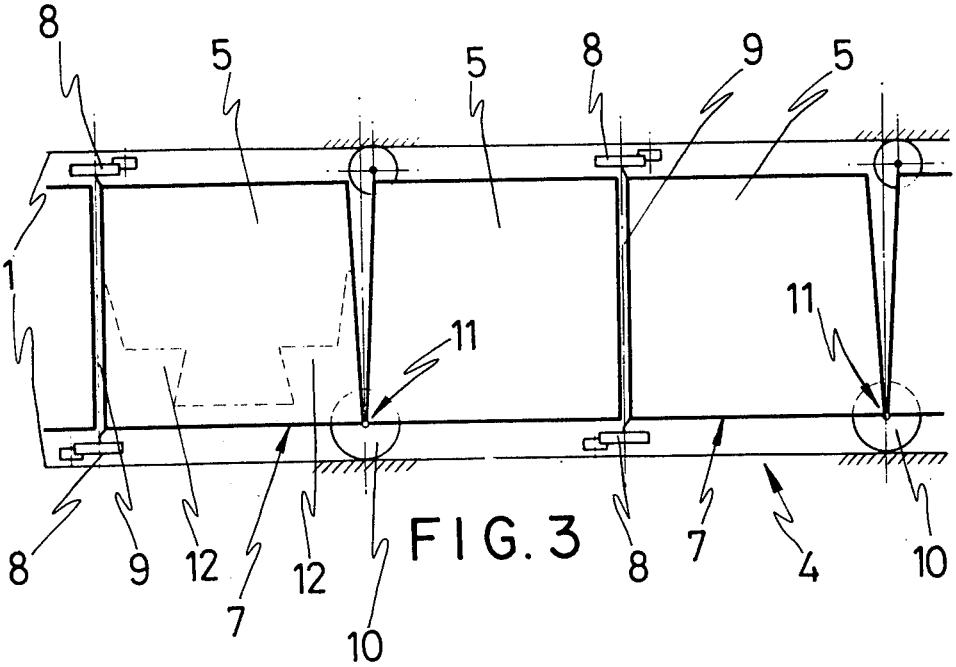
FIG. 3 is a schematic side view of the system of FIG. 1.

As shown in FIGS. 2 and 3, pivotal connection between alternate compartments 5 is about axles 9 which extend vertically and which have at each end thereof a guide wheel 8. The upper and lower guide wheels 8 of each axle 9 contact and ride on the inner surface of the outer legs of the respective upper and lower U-shaped elements 3 of the track 1. The pivotal connection about vertical axles 9 accounts for horizontal curves in the track.

As also shown in FIGS. 2 and 3, pivotal connection between alternate compartments 5, alternate to connection about axles 9, is about horizontal axles 11 at the bottom of the compartments. Each axle 11 has the inner end thereof a traction wheel 10 which rides on the upper surface of the web of the lower U-shaped element 3 of the track 1. The pivotal connection about axles 11 accounts for vertical curves in the track.

Figure 4:
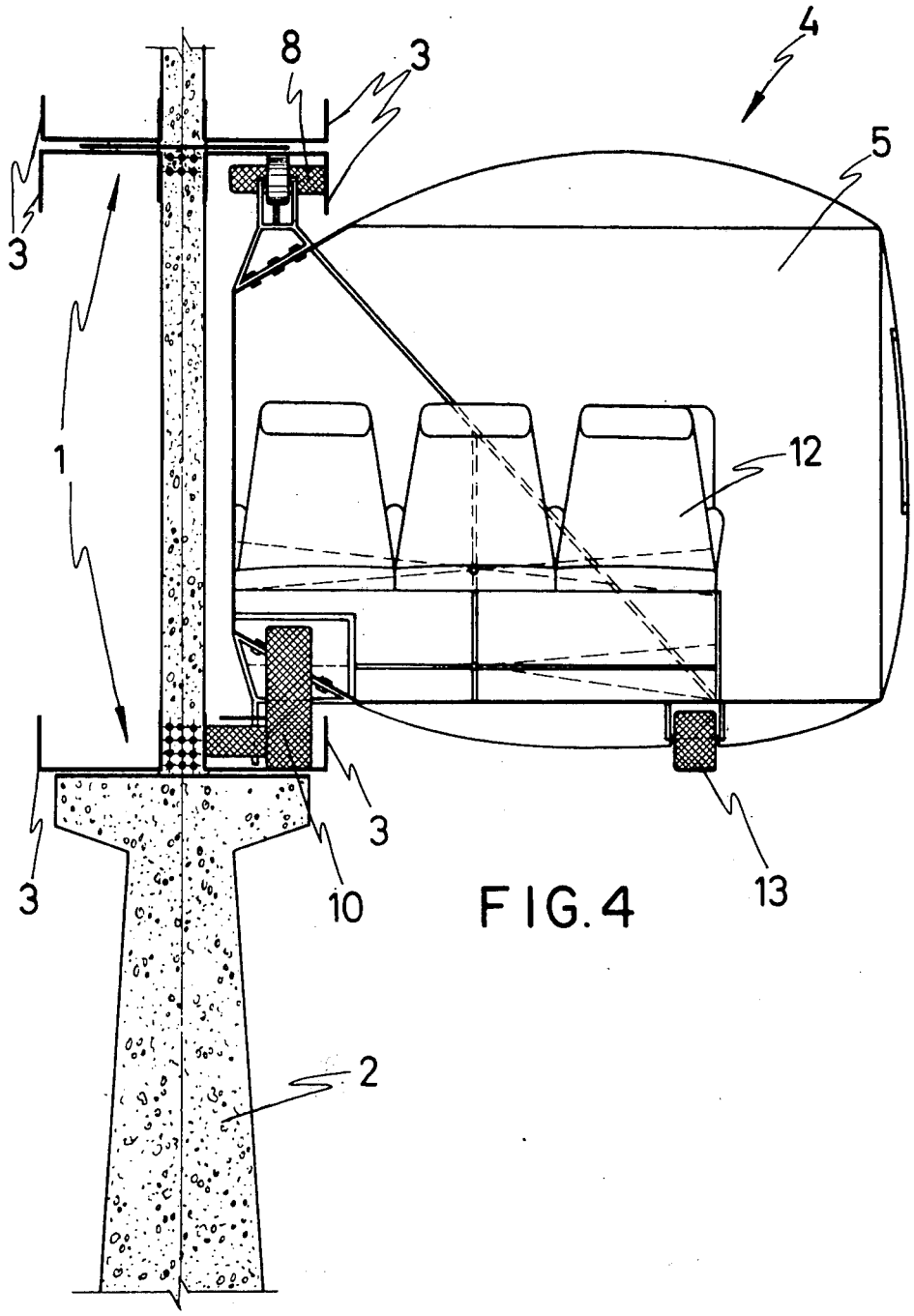
FIG. 4 is an enlarged schematic view, partially in cross-section, of the system of FIG. 1, wherein the alignment of the axis of the track is parallel to the vertical axis of the support assembly.

FIG. 4 illustrates an arrangement wherein the vertical axis of the track, i.e. an axis of both U-shaped elements 3 of track 1, is parallel to the vertical axis of support columns 2.

Figure 5:
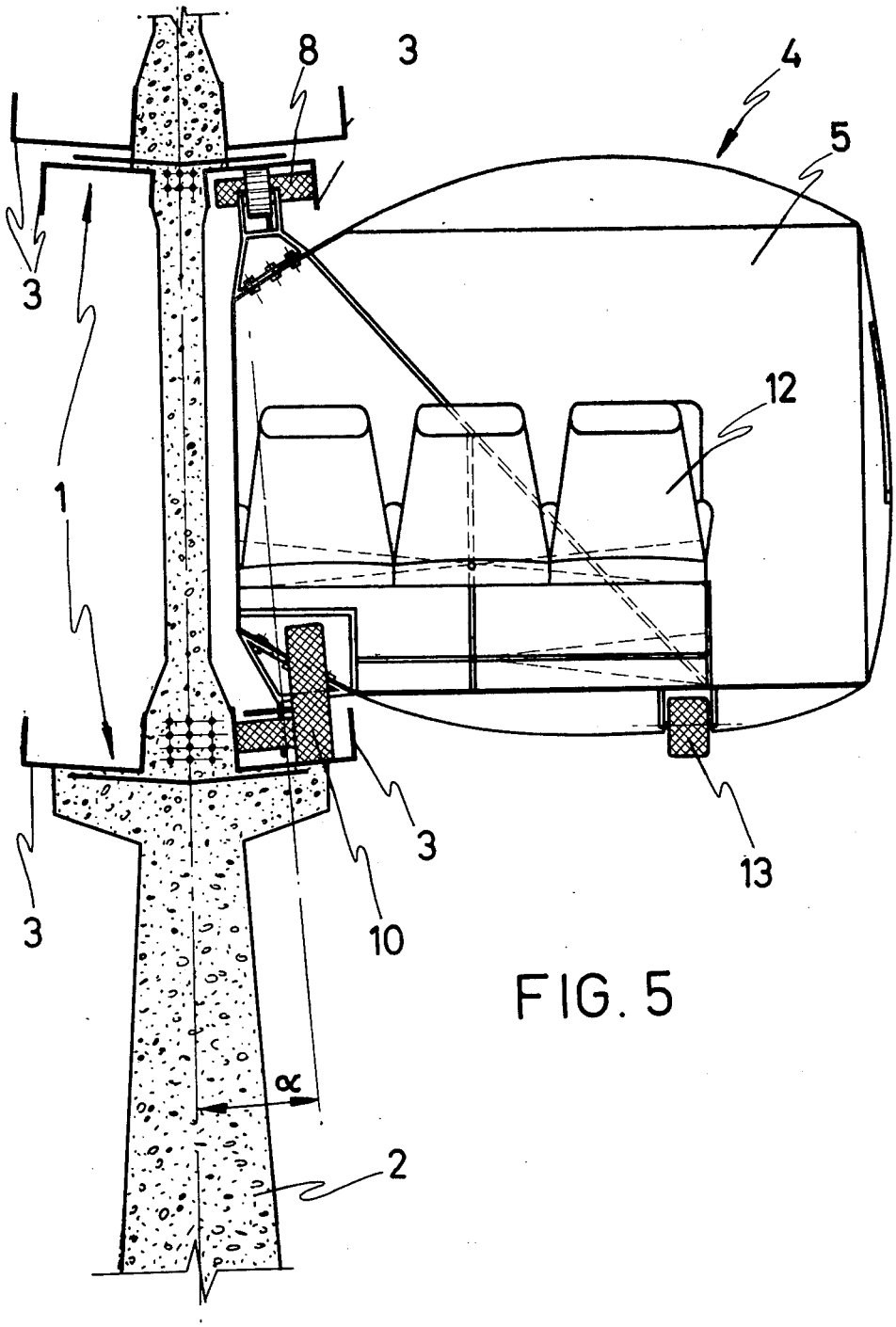
FIG. 5 is a view similar to FIG. 4, but wherein the alignment of the axis of the track is upwardly and inwardly inclined with respect to the vertical axis of the support assembly.

FIG. 5 illustrates an arrangement wherein the axis of the track is slightly inclined upwardly and inwardly with respect to the vertical axis of support columns 2.

The pillars or columns 2 are sized to meet the requirements of a particular installation with regard to stresses and to the number of simultaneous circulations or tracks which form the supporting assembly of the system.

Each of the roller tracks 1 is formed of U-shaped elements 3 made of metal or any other suitable material. The elements 3 are arranged parallelly to each other and with the cavities or channels thereof facing each other.

Coupling of each pair of U-shaped elements 3 of each roller track to the supporting assembly 2 of the system is effected either at an axis parallel to the latter (see FIG. 4) or slightly inclined thereto (see FIG. 5). In either case, symmetry as well as the possibility of parallel circulation in opposite directions are provided.

The vertebrated or segmented train element 4 is as light of weight as permitted by known technology. The compartments 5 are pivotally joined to each other in an alternate manner about vertical axles 9, having guide wheels 8 on opposite ends thereof, and about horizontal axles 11, having on the inner ends thereof traction wheels 10.

The train element 4 is not itself allowed to raise or tilt when moving at high speeds about curves. However, the frames of seats 12 are allowed to raise or tilt, depending on the speed of circulation, mechanically or hydraulically to adopt a satisfactory inclined position. By way of example, FIG. 1 illustrates frames 12 arranged at an inclined position with respect to the horizontal plane.

Reverting again to the wheel assemblies of the system, it will be apparent that damping is achieved by the flexible or resilient surface of the driving, fastening and guide means, and may be aided by providing leaf springs in the system. It is contemplated that the driving or traction wheels 10 be fed with electrical energy which may be controlled from a control cabin. Wheels

10 may preferably be provided with electric-generator brakes while the fastening and guide wheels 8 preferably would have disc brakes.

In the overhead transportaion system of the invention, the train elements 4 may be provided with emergency exits directly to the ground for those train elements located near the ground. Such exits may have extensible stairs or steps (not represented) leading from within the compartments 5. In the train elements 4 which circulate along higher roller tracks 1, emergency exits may be arranged in the roof and floor of the compartments 5 to be connected to upper and lower train elements 4, respectively.

A rapid and uniform exit for all passengers at stations is achieved due to levelling of the lower plane or surface of the train element by the contact of wheels 13 on the bottoms of the compartments with the platform of the station, thus facilitating the comfortable exit of passengers from each of the compartments.

Various modifications to the specific arrangements described above may be made without departing from the scope of the invention.

I claim:

1. An elevated transportation system comprising:

a plurality of vertical support columns positioned spaced along a desired path;

at least one roller track attached to said support columns, said track comprising upper and lower U-shaped elements extending parallel to each other and having open channels facing each other;

a segmented movable train element mounted to move along said track and comprising a plurality of successively pivotally connected compartments;

alternate first junctions, between adjacent of said compartments, comprising pivotal connections about vertical axles at lateral sides of said compartments closest to said track, said first junctions comprising means for accomodating horizontal curves in said track;

alternate second junctions, intermediate said first junctions, between adjacent of said compartments, comprising pivotal connections about horizontal axles at the bottoms of said compartments, said second junctions comprising means for accomodating vertical curves in said track;

each of said vertical axles having at the upper and lower ends thereof guide wheels which respectively ride within and against said upper and lower U-shaped elements of said track; and each of said horizontal axles having at the end thereof nearest said track a traction wheel contacting said lower U-shaped element of said track.

2. A system as claimed in claim 1, including a plurality of tracks connected to opposite sides of said support columns and superimposed in vertical layers; and a plurality of train elements, one each mounted to move along a respective track.

3. A system as claimed in claim 1, wherein a vertical axis of both said upper and lower U-shaped elements is parallel to a vertical axis of said support columns.

4. A system as claimed in claim 1, wherein a vertical axis of both said upper and lower U-shaped elements is slightly inclined upwardly and toward a vertical axis of said support columns.

5. A system as claimed in claim 1, further comprising seats in said compartments, said seats being mounted to be vertically movable in response to the speed and degree of curve of the path of movement of said train element.

* * * * *